US011130646B2

(12) United States Patent
Nishikawa et al.

(10) Patent No.: US 11,130,646 B2
(45) Date of Patent: Sep. 28, 2021

(54) PAPER FEEDING PARAMETER MANAGEMENT SYSTEM

(71) Applicant: Konica Minolta, Inc., Tokyo (JP)

(72) Inventors: Eiji Nishikawa, Tama (JP); Takahiro Yokoya, Tama (JP)

(73) Assignee: Konica Minolta, Inc., Tokyo (JP)

( * ) Notice: Subject to any disclaimer, the term of this patent is extended or adjusted under 35 U.S.C. 154(b) by 252 days.

(21) Appl. No.: 16/505,858

(22) Filed: Jul. 9, 2019

(65) Prior Publication Data

US 2020/0017326 A1 Jan. 16, 2020

(30) Foreign Application Priority Data

Jul. 13, 2018 (JP) ..... JP2018-132835

(51) Int. Cl.
*B65H 7/16* (2006.01)
*B65H 7/06* (2006.01)
*B65H 3/12* (2006.01)

(52) U.S. Cl.
CPC ..... *B65H 7/16* (2013.01); *B65H 3/128* (2013.01); *B65H 7/06* (2013.01); *B65H 2511/528* (2013.01); *B65H 2511/529* (2013.01); *B65H 2515/112* (2013.01); *B65H 2515/81* (2013.01)

(58) Field of Classification Search
CPC ... B65H 1/00; B65H 1/04; B65H 7/00; B65H 7/02; B65H 7/06; B65H 7/14; B65H 7/16; B65H 7/18; B65H 7/20; B65H 2511/528; B65H 2511/529; B65H 2515/112; B65H 2515/81; G03G 15/5029; G03G 15/6508
See application file for complete search history.

(56) References Cited

U.S. PATENT DOCUMENTS

2012/0120421 A1* 5/2012 Mochizuki ..... H04N 1/3877 358/1.9
2013/0181390 A1* 7/2013 Matsunaga ..... G03G 15/553 271/9.01
2014/0341598 A1* 11/2014 Kobayashi ..... G03G 15/5029 399/45
2019/0185280 A1* 6/2019 Nishikawa ..... B65H 3/08

FOREIGN PATENT DOCUMENTS

JP 2008-097382 4/2008

* cited by examiner

*Primary Examiner* — Prasad V Gokhale
(74) *Attorney, Agent, or Firm* — BakerHostetler

(57) ABSTRACT

A paper feeding parameter management system may include air paper feeding devices and a management device. Each of the air paper feeding devices may be provided with an air paper feeder which may feed paper by blowing air and by absorption to paper and which may be provided with a paper feeding parameter capable of being switched. Each of the air paper feeding devices may be provided with a paper type information obtaining unit and a hardware processor. The paper type information obtaining unit may obtain paper type information of paper to be fed. The hardware processor (i) may adjust the paper feeding parameter of the air paper feeder and (ii) may transmit the paper type information, device configuration information regarding a device configuration of the air paper feeding device, and the adjusted paper feeding parameter to the management device.

9 Claims, 7 Drawing Sheets

FIG. 6

T0

| PAPER TYPE INFORMATION | DEVICE CONFIGURATION INFORMATION | DISTURBANCE INFORMATION | PAPER FEEDING PARAMETER | RELIABILITY DATA |
|---|---|---|---|---|
| | | | | |
| | | | | |
| | | | | |
| | | | | |
| | | | | |

FIG. 7A

T1

| PAPER TYPE INFORMATION | DEVICE CONFIGURATION INFORMATION | PAPER FEEDING PARAMETER | MODEL INFORMATION |
|---|---|---|---|
| | | | |
| | | | |
| | | | |
| | | | |
| | | | |

FIG. 7B

T2

| PAPER TYPE INFORMATION | DEVICE CONFIGURATION INFORMATION | DISTURBANCE INFORMATION | PAPER FEEDING PARAMETER DIFFERENCE | MODEL INFORMATION |
|---|---|---|---|---|
| | | | | |
| | | | | |
| | | | | |
| | | | | |
| | | | | |

PAPER FEEDING PARAMETER MANAGEMENT SYSTEM

REFERENCE TO RELATED APPLICATIONS

This application claims priority to Japanese patent application No. 2018-132835, filed on Jul. 13, 2018, which is incorporated herein by reference in its entirety.

BACKGROUND

1. Technological Field

The present disclosure relates to a paper feeding parameter management system.

2. Description of the Related Art

Conventionally, an air suction type paper feeding device (hereinafter, referred to as an air paper feeding device) is known as a paper feeding device for feeding paper to an image forming device. In the air paper feeding device, air is blown from a side surface of stacked paper bundle to separate the paper, and uppermost paper is absorbed and conveyed, so that the paper is fed one by one. In the air paper feeding device, an optimal paper feeding condition (paper feeding parameter) is set according to a paper type.

In the image forming device, various control parameters are used. For example, suggested is a technology of determining a parameter for controlling a fixing process on the basis of state information including the type of the paper transmitted from the image forming device and temperature of fixing means in a host device connected to the image forming device and transmitting the same to the image forming device (refer to JP 2008-97382 A).

However, in the air paper feeding device, it is difficult to prepare in advance the optimal paper feeding conditions for various paper types. Therefore, a technology of providing adjusting means for adjusting the paper feeding parameter on the paper feeding device side, and calculating an optimal parameter by collecting an adjustment result of the paper feeding parameter from the paper feeding device by the management device side connected to the paper feeding device via a communication network is used. Especially, in a case of long paper passing, an effect of a connection order of the paper feeding devices, a tray position and the like is large, and it is difficult to optimize the paper feeding parameter.

SUMMARY

The present disclosure relates to a solution to one or more of the above-described problems in the conventional art, and an object thereof may be to secure reliability of an adjustment result of paper feeding parameters collected by a management device.

To achieve at least one of the abovementioned objects, according to an aspect of the present disclosure, a paper feeding parameter management system may include: air paper feeding devices each of which is provided with an air paper feeder which feeds paper by air blow and absorption to paper and which is provided with a paper feeding parameter capable of being switched; and a management device connected to the air paper feeding devices via a communication network, wherein each of the air paper feeding devices is provided with: a paper type information obtaining unit which obtains paper type information of paper to be fed; and a first hardware processor which (i) adjusts the paper feeding parameter of the air paper feeder and (ii) transmits the paper type information obtained by the paper type information obtaining unit, device configuration information regarding a device configuration of the air paper feeding device, and the adjusted paper feeding parameter to the management device, the management device is provided with a second hardware processor which (i) associates the paper type information, the device configuration information, and the paper feeding parameter transmitted from each of the air paper feeding devices to store in a storage, and (ii) sets the paper feeding parameter with reference to the storage, the paper feeding parameter being correspond to: the paper type information obtained by the paper type information obtaining unit of a first air paper feeding device to be processed among the air paper feeding devices; and the device configuration information of the first air paper feeding device, the first hardware processor further transmits reliability data for the adjusted paper feeding parameter to the management device, and the second hardware processor determines reliability of the paper feeding parameter regarding the reliability data based on the transmitted reliability data and determines whether to store the paper feeding parameter in the storage according to the reliability.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the present disclosure.

FIG. 6 illustrates a data configuration example of a paper feeding parameter table stored in the image forming device.

FIG. 7A is a data configuration example of an in-criterion range table stored in the management device.

FIG. 7B is a data configuration example of a disturbance adjustment table stored in the management device.

DETAILED DESCRIPTION OF EMBODIMENTS

Hereinafter, one or more embodiments of the present disclosure will be described with reference to the drawings. However, the scope of the disclosure is not limited to the disclosed embodiments.

First Embodiment

A first embodiment of a paper feeding parameter management system according to the present disclosure is first described. Note that the present disclosure is not limited to the illustrated example.

Figure 1:
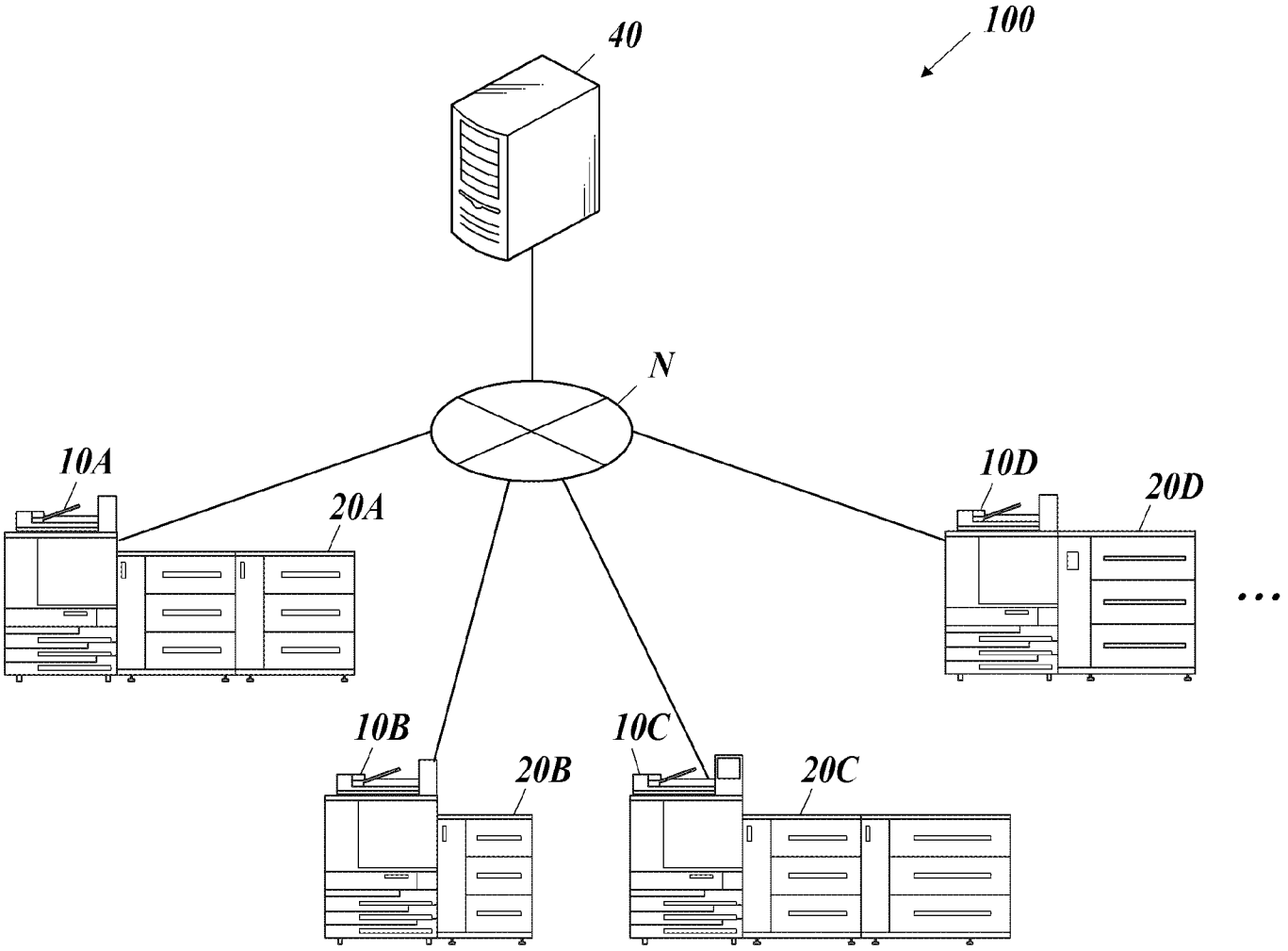
FIG. 1 is a system configuration diagram of a paper feeding parameter management system according to a first embodiment of the present disclosure.

FIG. 1 illustrates a system configuration of a paper feeding parameter management system 100 according to the first embodiment. In the paper feeding parameter management system 100, a plurality of image forming devices 10A, 10B, 10C, 10D, . . . and a management device 40 are connected to one another via a communication network N such as the Internet and a local area network (LAN) so as to be able to perform data communication. The image forming devices 10A, 10B, 10C, 10D, . . . are provided with paper feeding devices 20A, 20B, 20C, 20D, . . . as air paper feeding devices, respectively. Hereinafter, when the image forming devices 10A, 10B, 10C, 10D, . . . and the paper feeding devices 20A, 20B, 20C, 20D, . . . are not distinguished from one another, they are referred to as the image forming device 10 and the paper feeding device 20, respectively.

Figure 2:
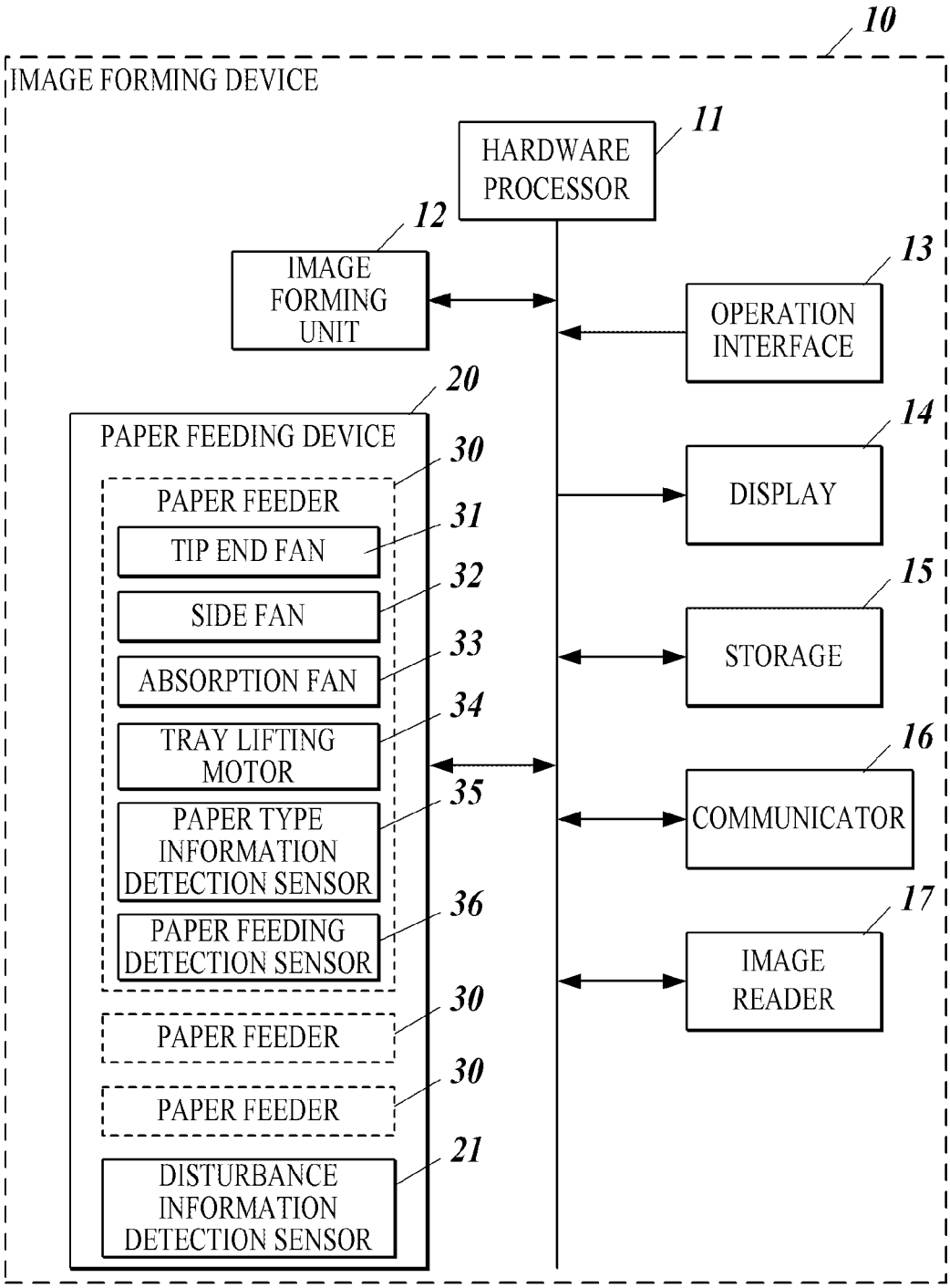
FIG. 2 is a block diagram illustrating a functional configuration of an image forming device.

A functional configuration of the image forming device 10 is illustrated in FIG. 2. The image forming device 10 includes a hardware processor 11, an image forming unit 12, the paper feeding device 20, an operation interface 13, a display 14, a storage 15, a communicator 16, an image reader 17 and the like, and each unit is connected via a bus.

The hardware processor 11 is formed of a central processing unit (CPU), a read only memory (ROM), a random access memory (RAM) and the like, and comprehensively controls processing operation of each unit of the image forming device 10. The CPU reads various processing programs stored in the ROM, develops them in the RAM, and executes various processes in accordance with the developed programs.

The image forming unit 12 forms an image on paper fed from the paper feeding device 20 on the basis of image data read by the image reader 17 or the image data received from an external device by the communicator 16. For example, the image forming unit 12 forms an image by an electrophotographic method using toner of respective colors of yellow, magenta, cyan, and black.

The paper feeding device 20 is provided with one or a plurality of paper feeders 30, a disturbance information detection sensor 21 and the like. Each paper feeder 30 is an air paper feeder which feeds paper by air blow and absorption to the paper. The paper feeder 30 is provided with a tip end fan 31, a side fan 32, an absorption fan 33, a tray lifting motor 34, a paper type information detection sensor 35, a paper feeding detection sensor 36 and the like.

Figure 3:
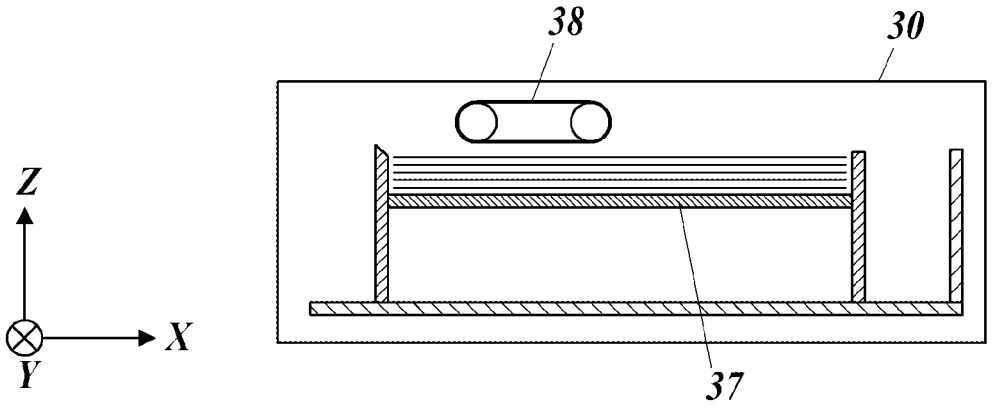
FIG. 3 is a schematic diagram illustrating a cross-sectional configuration of a paper feeder in a paper feeding direction.

FIG. 3 is a schematic diagram illustrating a cross-sectional configuration of the paper feeder 30 in a paper feeding direction. The paper feeder 30 is provided with a lifting tray 37, a paper feeding belt 38 and the like. Paper stacked on the lifting tray 37 is absorbed and conveyed by the paper feeding belt 38, and fed one by one leftward in an X direction illustrated in FIG. 3.

The tip end fan 31 blows air to the paper from a tip end side in the paper feeding direction of a paper bundle stacked on the lifting tray 37 to separate uppermost paper. That is, the tip end fan 31 blows air rightward in the X direction illustrated in FIG. 3 from the tip end side in the paper feeding direction of the paper bundle.

The side fans 32 blow air to the paper from both ends of the paper orthogonal to the paper feeding direction of the paper bundle stacked on the lifting tray 37 to allow upper paper to flow. That is, the side fans 32 blow air from the both sides in a paper width direction of the paper bundle in both directions in a Y direction illustrated in FIG. 3 (from a near side to a far side and from the far side to the near side with respect to a paper surface of FIG. 3).

The absorption fan 33 sucks air from a vent formed on the paper feeding belt 38 to allow the paper to be absorbed by the paper feeding belt 38. That is, the absorption fan 33 allows the paper to be absorbed upward in a Z direction illustrated in FIG. 3.

The tray lifting motor 34 moves the lifting tray 37 in the Z direction (vertical direction, paper stacking direction) illustrated in FIG. 3 to adjust a position of the paper stacked in the tray.

The paper type information detection sensor 35 is a detector which detects paper type information from the paper to be fed in the paper feeder 30, and outputs the detected paper type information to the hardware processor 11. That is, the paper type information detection sensor 35 is a paper type information obtaining unit which obtains the paper type information of the paper to be fed. The paper type information detection sensor 35 is formed of a reflection type photoelectric sensor, a thickness detection sensor and the like. The paper type information detection sensor 35 may be provided in the tray of the paper feeder 30 or may be provided on a paper conveyance path. The paper type information includes a surface property, a basis weight, and stiffness of the paper.

The paper feeding detection sensor 36 is a sensor which detects passage of the paper in the paper feeder 30, and detects a paper bending amount, a paper deviation amount, paper feeding timing, occurrence of jamming, double feeding and the like and outputs a detection result to the hardware processor 11. The paper bending amount is an amount indicating how much the paper is bent obliquely with respect to a conveying direction. The paper deviation amount is an amount indicating how much the paper is deviated in a width direction (a direction orthogonal to the paper conveying direction and parallel to the paper surface). The paper feeding timing is a value indicating timing at which the paper is fed, and is represented by, for example, a time difference from target timing.

The disturbance information detection sensor 21 detects disturbance information and outputs the detected disturbance information to the hardware processor 11. The disturbance information includes environmental information indicating an environment in which the image forming device 10 is installed, and usage condition information indicating a usage condition of parts of the paper feeding device 20. Temperature, humidity and the like are used as the environmental information. As the usage condition information, time elapsed after replacing the parts, the number of fed sheets of paper and the like are used.

The operation interface 13 provided with a touch panel formed so as to cover a display screen of the display 14 and various operation buttons such as numeric buttons and a start button outputs an operation signal based on user's operation to the hardware processor 11.

The display 14 is formed of a liquid crystal display (LCD), and displays various screens according to an instruction of a display signal input from the hardware processor 11.

The storage 15 is formed of a storage device such as a non-volatile semiconductor memory and a hard disk, and stores data and the like regarding various processes. The storage 15 is provided with a passed sheet number counter for each of the paper feeders 30 of the paper feeding device 20.

The communicator 16 transmits and receives the data to and from an external device such as the management device 40 connected to the communication network N.

The image reader 17 optically scans a document conveyed from an auto document feeder (ADF) onto a contact glass or a document placed on the contact glass, forms an image of reflected light of light illuminated from a light source to scan the document on a light receiving surface of a charge coupled device (CCD) sensor, reads a document image, A/D converts the read image, and outputs the obtained image data to the hardware processor 11.

The hardware processor 11 may switch the paper feeding parameter in the paper feeder 30, and controls each unit of the paper feeding device 20 on the basis of the set paper feeding parameter. The paper feeding parameter is a parameter regarding paper feeding, and includes at least one of air volumes of the fans (the tip end fan 31 and the side fan 32) used for air blow, an air volume of the fan (absorption fan 33) used for adsorption, and a lifting position of the tray (lifting tray 37) on which the paper is stacked.

The hardware processor 11 adjusts the paper feeding parameter in the paper feeder 30 on the basis of operation from the operation interface 13 of the user.

The hardware processor 11 transmits the paper type information obtained by the paper type information detection sensor 35, device configuration information regarding a device configuration of the paper feeding device 20, and the adjusted paper feeding parameter to the management device 40 via the communicator 16. The device configuration information includes at least one of a length (paper length) in the conveying direction of the paper to be fed, a connection order of the paper feeders 30 which feed the paper, and a tray position of the paper feeder 30 which feeds the paper.

Figure 4:
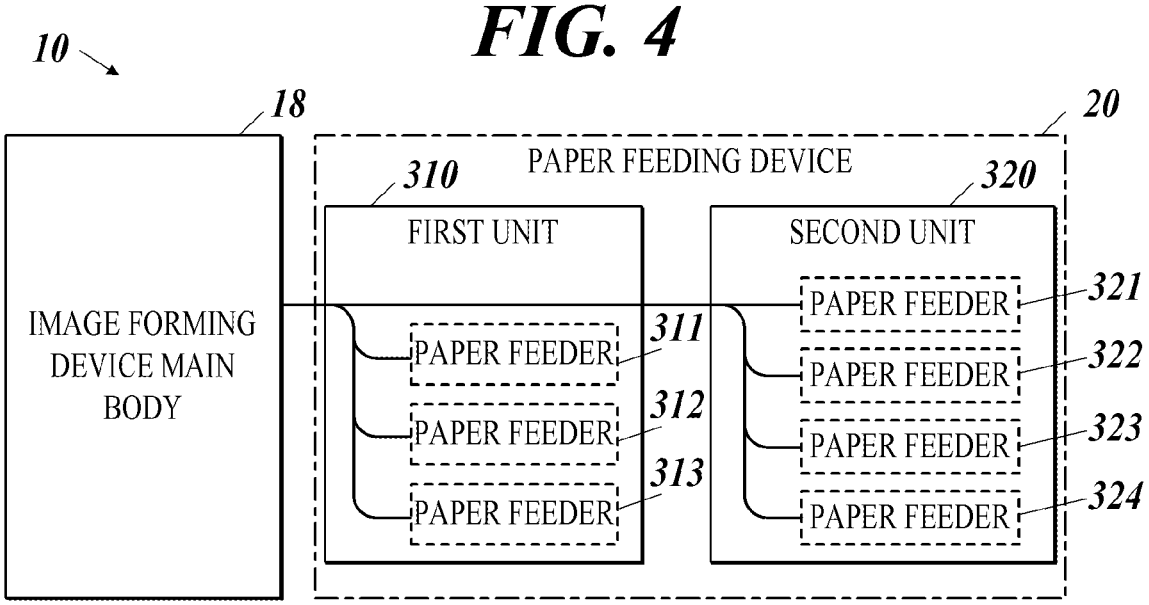
FIG. 4 is a view for explaining a connection order of paper feeders and a tray position in a paper feeding device.

The connection order and tray positions of the paper feeders 30 in the paper feeding device 20 are described with reference to FIG. 4. Note that, in FIG. 4, reference signs 311 to 313 and 321 to 324 are used for distinguishing the plurality of paper feeders 30. In the image forming device 10, the paper is fed from the paper feeding device 20 to an image forming device main body 18. In FIG. 4, in the paper feeding device 20, a first unit 310 and a second unit 320 are connected in this order from a side closer to the image forming device main body 18. The first unit 310 is provided with paper feeders 311 to 313 in this order from the top, and the second unit 320 is provided with paper feeders 321 to 324 in this order from the top. Note that FIG. 4 illustrates a case where two units in the paper feeding device 20 are connected in series to the image forming device main body 18, but the number of connected units is not limited to this.

The paper feeder 311 corresponds to a first tray from the top of a first unit (the first unit 310) in connection order.

The paper feeder 312 corresponds to a second tray from the top of the first unit (first unit 310) in connection order.

The paper feeder 313 corresponds to a third tray from the top of the first unit (the first unit 310) in connection order.

The paper feeder 321 corresponds to a first tray from the top of a second unit (the second unit 320) in connection order.

The paper feeder 322 corresponds to a second tray from the top of the second unit (the second unit 320) in connection order.

The paper feeder 323 corresponds to a third tray from the top of the second unit (the second unit 320) in connection order.

The paper feeder 324 corresponds to a fourth tray from the top of the second unit (the second unit 320) in connection order.

The hardware processor 11 transmits the disturbance information indicating the environment in which the image forming device 10 (paper feeding device 20) is installed, or the usage condition of the parts of the paper feeder 30 of the paper feeding device 20 together with the paper type information, the device configuration information, and the paper feeding parameter to the management device 40 via the communicator 16.

The hardware processor 11 transmits model information of the paper feeding device 20 and model information of the image forming device 10 (the image forming device 10 provided with the paper feeding device 20) to which the paper feeding device 20 is connected together with the paper type information, the device configuration information, and the paper feeding parameter to the management device 40 via the communicator 16. When the model of the paper feeding device 20 is the same but the model of the image forming device main body 18 is different, a paper interval is different due to a difference in paper conveying linear velocity and the like, so that an appropriate paper feeding parameter might be different.

The hardware processor 11 transmits reliability data for the adjusted paper feeding parameter to the management device 40 via the communicator 16 together with the paper type information, the device configuration information, and the paper feeding parameter. The reliability data is information serving as an index for determining reliability and effectiveness of the adjusted paper feeding parameter. The reliability data includes at least one of the number of passed sheets, a jamming occurrence rate, a variation amount of the paper bending amount, a variation amount of the paper deviation amount, and a variation amount of the paper feeding timing in a state of using the adjusted paper feeding parameter.

The jamming occurrence rate is obtained by (number of times of occurrence of jamming in a state of using the paper feeding parameter/number of passed sheets in a state of using the paper feeding parameter)*100 [%].

The variation amount is obtained by standard deviation, variance and the like of target values (the paper bending amount, the paper deviation amount, and the paper feeding timing in a state of using the paper feeding parameter).

Figure 5:
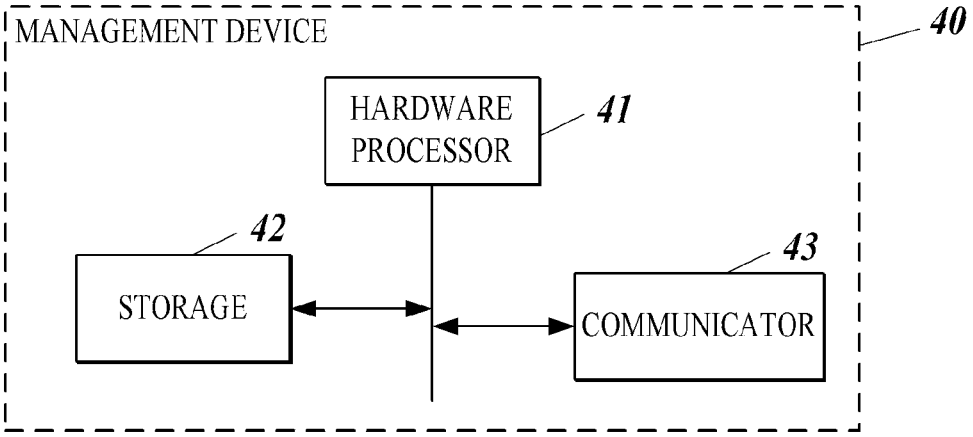
FIG. 5 is a block diagram illustrating a functional configuration of a management device.

A functional configuration of the management device 40 is illustrated in FIG. 5. The management device 40 is provided with a hardware processor 41, a storage 42, a communicator 43 and the like, and each unit is connected by a bus. The management device 40 collects and accumulates the paper feeding parameters in the plurality of image forming devices 10 (paper feeding devices 20), and provides the same to the respective image forming devices 10 (paper feeding devices 20).

The hardware processor 41 is formed of a CPU, a ROM, a RAM and the like, and comprehensively controls processing operation of each unit of the management device 40. The CPU reads various processing programs stored in the ROM, develops them in the RAM, and executes various processes in accordance with the developed programs.

The storage 42 is formed of a storage device such as a non-volatile semiconductor memory and a hard disk, and stores data and the like regarding various processes.

The communicator 43 transmits and receives data to and from an external device such as the image forming device 10 connected to the communication network N.

The hardware processor 41 associates the paper type information, the device configuration information, and the paper feeding parameters transmitted from each of the plurality of image forming devices 10 with one another, and stores them in the storage 42. Specifically, the hardware processor 41 adds the data to a table (to be described later in detail) including a correspondence relationship among the paper type information, the device configuration information, and the paper feeding parameter and updates the table.

The hardware processor 41 determines the reliability of the paper feeding parameter regarding the reliability data on the basis of the reliability data transmitted from each image forming device 10, and determines whether to store the paper feeding parameter in the storage 42 according to the reliability.

For example, the hardware processor 41 stores the paper feeding parameter regarding the number of passed sheets in the storage 42 when the number of passed sheets in a state of using the adjusted paper feeding parameter is equal to or larger than a predetermined number, and does not store the paper feeding parameter regarding the number of passed sheets in the storage 42 when the number of passed sheets in a state of using the adjusted paper feeding parameter is smaller than the predetermined number.

In addition, the hardware processor 41 stores the paper feeding parameter regarding the jamming occurrence rate in the storage 42 when the jamming occurrence rate in a state of using the adjusted paper feeding parameter is equal to or smaller than a predetermined value, and does not store the paper feeding parameter regarding the jamming occurrence rate in the storage 42 when the jamming occurrence rate in a state of using the adjusted paper feeding parameter is larger than the predetermined value.

Also, when the variation amount of the paper bending amount, the paper deviation amount, or the paper feeding timing in a state of using the adjusted paper feeding parameter is equal to or smaller than a predetermined amount, the hardware processor 41 stores the paper feeding parameter regarding the variation amount in the storage 42. When the variation amount of the paper bending amount, the paper deviation amount, or the paper feeding timing in a state of using the adjusted paper feeding parameter is larger than the predetermined amount, the hardware processor 41 does not store the paper feeding parameter regarding the variation amount in the storage 42.

The hardware processor 41 changes a determination criterion of the reliability of the paper feeding parameter on the basis of the device configuration information transmitted together with the paper feeding parameter. For example, when the paper fed from the paper feeding device 20 provided in the image forming device 10 is long paper, the hardware processor 41 makes the determination criterion of the reliability of the paper feeding parameter stricter than that when the paper is not the long paper. This is because the long paper is more affected by a defect due to skew or the like. Specifically, when the reliability data is "the number of passed sheets in a state in which the adjusted paper feeding parameter is used", increasing "the predetermined number of sheets" used for determining the reliability corresponds to making the determination criterion for the reliability stricter. In addition, when the reliability data is "the jamming occurrence rate in a state in which the adjusted paper feeding parameter is used", decreasing "the predetermined value" used for determining the reliability corresponds to making the determination criterion for the reliability stricter. In addition, when the reliability data is "the variation amount of the paper bending amount, the paper deviation amount, or the paper feeding timing in a state of using the adjusted paper feeding parameter", decreasing "the predetermined value" used for determining the reliability corresponds to making the determination criterion for reliability stricter.

The long paper refers to paper a long side of which is equal to or longer than a predetermined length. For example, paper having a long side of 900 mm or longer and paper having a length of 1200 mm or longer are considered as the long paper.

The hardware processor 41 updates the adjustment result on the basis of the disturbance information transmitted from each of the image forming devices 10.

When the disturbance information is within a predetermined range, the hardware processor 41 updates the correspondence relationship among the paper type information, the device configuration information, and the paper feeding parameter, and when the disturbance information is not within the predetermined range, this stores the paper type information, the device configuration information, and the paper feeding parameter transmitted together with the disturbance information in association with the disturbance information. Hereinafter, the predetermined range is referred to as a criterion range.

The hardware processor 41 updates the adjustment result on the basis of the model information transmitted from each of the image forming devices 10. Specifically, the hardware processor 41 stores the paper type information, the device configuration information, and the paper feeding parameter transmitted together with the model information in association with the model information.

The hardware processor 41 sets the paper feeding parameter corresponding to the paper type information obtained by the paper type information detection sensor 35 of the image forming device 10 to be processed and the device configuration information of the image forming device 10 (paper feeding device 20) to be processed with reference to the adjustment result stored in the storage 42 for the image forming device 10 to be processed among the plurality of image forming devices 10.

The hardware processor 41 sets the paper feeding parameter corresponding to the paper type information and the device configuration information obtained by the image forming device 10 in the image forming device 10 from which the paper feeding parameter is requested out of the plurality of image forming devices 10.

Next, tables managed by each of the image forming devices 10 and the management device 40 are described.

FIG. 6 illustrates a data configuration example of a paper feeding parameter table T0 stored in the storage 15 of the image forming device 10. The paper type information, the device configuration information, the disturbance information, the paper feeding parameter, and the reliability data are stored in the paper feeding parameter table T0 in association with one another.

In a "paper type information" field, the paper type information (surface property, basis weight, stiffness and the like of the paper) of the paper for which the paper feeding parameter is adjusted is stored.

A "device configuration information" field stores the device configuration information (paper length, connection order, tray position and the like) of the paper feeding device 20 regarding the paper for which the paper feeding parameter is adjusted.

A "disturbance information" field stores the disturbance information (temperature, humidity, time elapsed after replacing parts, the number of sheets fed after replacing the parts and the like) obtained when adjusting the paper feeding parameter.

A "paper feeding parameter" field stores the adjusted paper feeding parameters (air volume of an air blowing fan, air volume of the absorption fan, lifting position of the tray and the like).

In a "reliability data" field, information used when determining the reliability of the paper feeding parameter (the number of passed sheets, jamming occurrence rate, variation amount of paper bending amount, variation amount of paper deviation amount, variation amount of paper feeding timing and the like) is stored. The reliability data is desirably the data obtained after passing the predetermined number of sheets for a predetermined time or longer.

FIG. 7A illustrates a data configuration example of an in-criterion range table T1 stored in the storage 42 of the management device 40. In the in-criterion range table T1, the paper type information, the device configuration information, the paper feeding parameter, and the model information are stored in association with one another.

FIG. 7B illustrates a data configuration example of a disturbance adjustment table T2 stored in the storage 42 of the management device 40. In the disturbance adjustment table T2, the paper type information, the device configuration information, the disturbance information, a paper feeding parameter difference, and the model information are stored in association with one another.

When it is determined to register the paper feeding parameter on the basis of the reliability data, the hardware processor 41 determines whether the disturbance information received from the image forming device 10 is within the criterion range.

When the disturbance information received from the image forming device 10 falls within the criterion range, the hardware processor 41 stores the paper type information, the device configuration information, the paper feeding parameter, and the model information received from the image forming device 10 in the in-criterion range table T1 in association with one another.

Note that, when the hardware processor 41 obtains the paper feeding parameters under the same condition (combination of the paper type information and the device configuration information) from the plurality of image forming devices 10, this may also calculate an average value of the paper feeding parameters and store the average value as the paper feeding parameter corresponding to the combination of the paper type information and the device configuration information. In this case, a "model information" field of the in-criterion range table T1 stores the model information of the plurality of image forming devices 10 or the paper feeding devices 20 which transmit each paper feeding parameter used for averaging.

On the other hand, when the disturbance information received from the image forming device 10 is not within the criterion range (when an effect due to the disturbance cannot be ignored), the hardware processor 41 obtains a record corresponding to the paper type information and the device configuration information received from the image forming device 10 from the in-criterion range table T1 illustrated in FIG. 7A and obtains a difference between the paper feeding parameter received from the image forming device 10 and the paper feeding parameter in the obtained record. That is, a value of the paper feeding parameter (the paper feeding parameter corresponding to the same condition as the current one except the disturbance information) in the record obtained from the in-criterion range table T1 is subtracted from a value of the paper feeding parameter received from the image forming device 10, and this is made the "paper feeding parameter difference". Then, the hardware processor 41 stores the paper type information, the device configuration information, the disturbance information, the paper feeding parameter difference, and the model information in the disturbance adjustment table T2 in association with one another.

Next, operation in the paper feeding parameter management system 100 is described.

Figure 8:
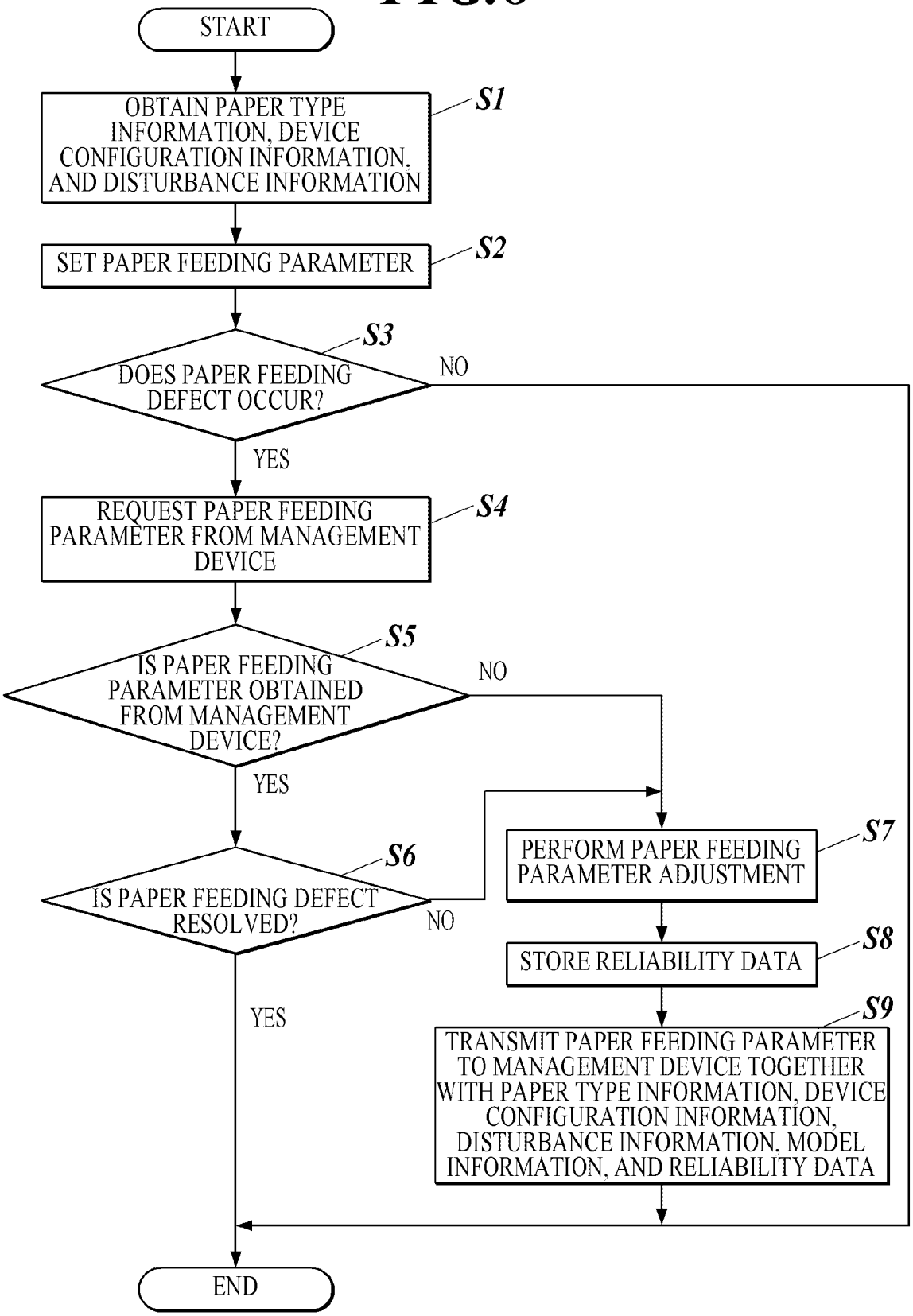
FIG. 8 is a flowchart illustrating a paper feeding parameter adjusting process executed in the image forming device.

FIG. 8 is a flowchart illustrating a paper feeding parameter adjusting process executed in the image forming device 10. This process is realized by software processing by the CPU of the hardware processor 11 and the program stored in the ROM in cooperation with each other.

First, the hardware processor 11 obtains the paper type information of the paper to be fed detected by the paper type information detection sensor 35, the device configuration information regarding the device configuration of the paper feeding device 20, and the disturbance information detected by the disturbance information detection sensor 21 (environmental information, usage condition information and the like) (Step S1).

Next, the hardware processor 11 reads the paper feeding parameter corresponding to the obtained paper type information, device configuration information, and disturbance information from the paper feeding parameter table T0 stored in the storage 15, and sets the read paper feeding parameter (Step S2). When there is no corresponding data in the paper feeding parameter table, the hardware processor 11 sets a predetermined paper feeding parameter.

Herein, the hardware processor 11 allows the paper feeder 30 of the paper feeding device 20 to perform paper feeding using the set paper feeding parameter. At that time, the hardware processor 11 determines whether a paper feeding defect occurs on the basis of the detection result of the paper feeding detection sensor 36 (Step S3). For example, when the paper bending amount, the paper deviation amount, or deviation in paper feeding timing (time difference) exceeds an allowable range, when the jamming occurs, and when the double feeding occurs, the hardware processor 11 determines that the paper feeding defect occurs.

When the paper feeding defect occurs (Step S3; YES), the hardware processor 11 transmits the paper type information, the device configuration information, and the disturbance information obtained at Step S1 and the model information to the management device 40 via the communicator 16 and requests the paper feeding parameter from the management device 40 (Step S4). The model information includes the model information of the image forming device 10 and the model information of the paper feeding device 20. The model information may also include version information.

Next, in response to the request of the paper feeding parameter from the management device 40, the hardware processor 11 determines whether the paper feeding parameter is obtained from the management device 40 via the communicator 16 (Step S5).

When the paper feeding parameter is obtained from the management device 40 (Step S5; YES), the hardware processor 11 sets the paper feeding parameter obtained from the management device 40.

Here, the hardware processor 11 allows the paper feeder 30 of the paper feeding device 20 to perform the paper feeding using the set paper feeding parameter, and determines whether the paper feeding defect is resolved (Step S6). The hardware processor 11 determines whether the paper feeding defect is resolved on the basis of the detection result by the paper feeding detection sensor 36.

At Step S5, when the paper feeding parameter is not obtained from the management device 40 (Step S5; NO), that is, when there is no corresponding data in the management device 40, or when the paper feeding defect is not resolved at Step S6 (Step S6; NO), the hardware processor 11 adjusts the paper feeding parameter (Step S7). Specifically, the hardware processor 11 changes the set values for various paper feeding parameters adjusted by the user from the operation interface 13. For example, the air volume of the tip end fan 31, the air volume of the side fan 32, the air volume of the absorption fan 33, the lifting position of the lifting tray 37 and the like are adjusted. The hardware processor 11 registers the adjusted paper feeding parameter in the paper feeding parameter table T0 of the storage 15 in association with the paper type information, the device configuration information, and the disturbance information.

The hardware processor 11 allows the paper feeding device 20 to perform the paper feeding using the adjusted paper feeding parameter, and stores the reliability data for the paper feeding parameter (Step S8). Specifically, the hardware processor 11 counts the number of passed sheets while allowing the paper feeding device 20 to feed the paper using the adjusted paper feeding parameter, and accumulates to store the paper bending amount, the paper deviation amount, the paper feeding timing, and the occurrence of jamming. For example, the hardware processor 11 calculates the number of passed sheets in a state of using the adjusted paper feeding parameter from a count value of the passed sheet number counter provided for each paper feeder 30. In addition, the hardware processor 11 records the paper bending amount, the paper deviation amount, the paper feeding timing, the occurrence of jamming and the like detected by the paper feeding detection sensor 36. Then, the hardware processor 11 calculates the variation amount of the paper bending amount, the variation amount of the paper deviation amount, the variation amount of the paper feeding timing, and the occurrence rate of jamming at a predetermined counting timing (predetermined time of day, after a predetermined time elapses after the adjustment of the paper feeding parameter, after a predetermined number of sheets pass after the adjustment of the paper feeding parameter).

Thereafter, the hardware processor 11 transmits the adjusted paper feeding parameter to the management device 40 via the communicator 16 together with the paper type information, the device configuration information, the disturbance information, the model information, and the reliability data (Step S9).

When no paper feeding defect occurs at Step S3 (Step S3; NO), when the paper feeding defect is resolved at Step S6 (Step S6; YES), or after Step S9, the paper feeding parameter adjusting process in the image forming device 10 ends.

Figure 9:
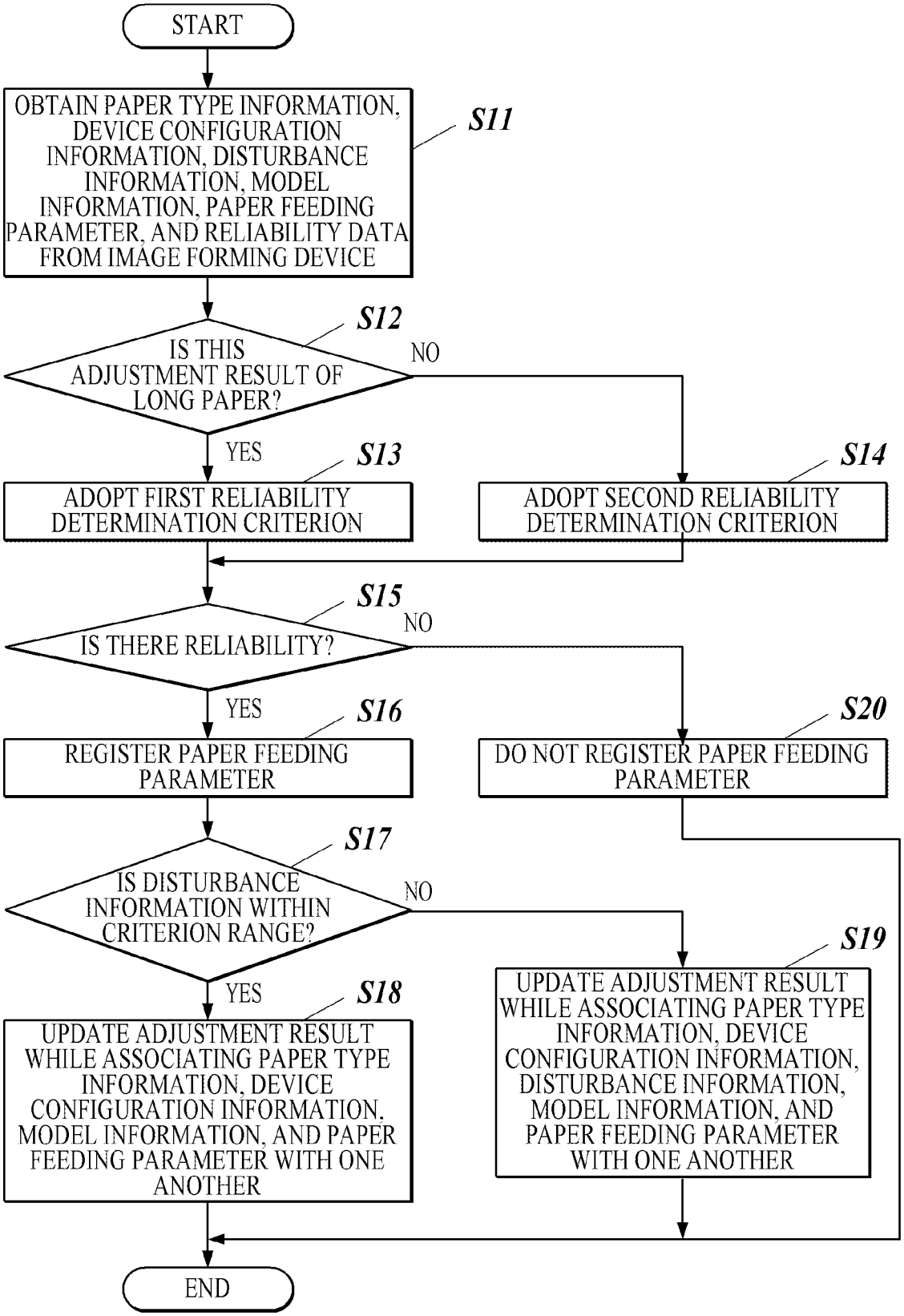
FIG. 9 is a flowchart illustrating a paper feeding parameter registering process executed in the management device.

FIG. 9 is a flowchart illustrating a paper feeding parameter registering process executed in the management device 40. This process is realized by software processing in cooperation with the CPU of the hardware processor 41 and the program stored in the ROM in cooperation with each other.

First, the hardware processor 41 obtains the paper type information, the device configuration information, the disturbance information, the model information, the paper feeding parameter, and the reliability data from any one of the image forming devices 10 via the communicator 43 (Step S11).

Next, the hardware processor 41 determines whether the paper feeding parameter obtained from the image forming device 10 is the adjustment result of the long paper on the basis of the paper length included in the device configuration information obtained from the image forming device 10 (Step S12). Specifically, when the paper length included in the device configuration information is equal to or longer than a predetermined length, the hardware processor 41 determines that this is the adjustment result of the long paper, and when the paper length included in the device configuration information is shorter than the predetermined length, this determines that this is the adjustment result of plain paper.

When this is the adjustment result of the long paper (Step S12; YES), the hardware processor 41 adopts a first reliability determination criterion (Step S13).

At Step S12, when this is not the adjustment result of the long paper (Step S12; NO), that is, when this is the adjustment result of the plain paper, the hardware processor 41 adopts a second reliability determination criterion (Step S14). Note that the second reliability determination criterion is a determination criterion looser than the first reliability determination criterion.

After Step S13 or Step S14, the hardware processor 41 determines the reliability of the paper feeding parameter regarding the reliability data on the basis of the reliability data obtained from the image forming device 10 (Step S15). At that time, the reliability determination criterion adopted at Step S13 or Step S14 is used.

When it is determined that the paper feeding parameter is reliable (Step S15; YES), the hardware processor 41 registers the paper feeding parameter (Step S16).

When registering the paper feeding parameter, the hardware processor 41 determines whether the disturbance information obtained at Step S11 is within the criterion range (Step S17).

When the disturbance information is within the criterion range (Step S17; YES), the hardware processor 41 associates the paper type information, the device configuration information, the model information, and the paper feeding parameter obtained at Step S11, and updates the adjustment result (Step S18). Specifically, the hardware processor 41 registers the paper type information, the device configuration information, the paper feeding parameter, and the model information in the in-criterion range table T1 in the storage 42 while associating them with one another.

At Step S17, when the disturbance information is not within the criterion range (Step S17; NO), the hardware processor 41 associates the paper type information, the device configuration information, the disturbance information, the model information, and the paper feeding parameter obtained at Step S11 with one another and updates the adjustment result (Step S19). Specifically, the hardware processor 41 registers the paper type information, the device configuration information, the disturbance information, the paper feeding parameter difference (difference from the case without the disturbance), and the model information in the disturbance adjustment table T2 of the storage 42 while associating them with one another.

At Step S15, when it is determined that the paper feeding parameter is not reliable (Step S15; NO), the hardware processor 41 does not register the paper feeding parameter (Step S20).

After Step S18, Step S19, or Step S20, the paper feeding parameter registering process is finished.

Figure 10:
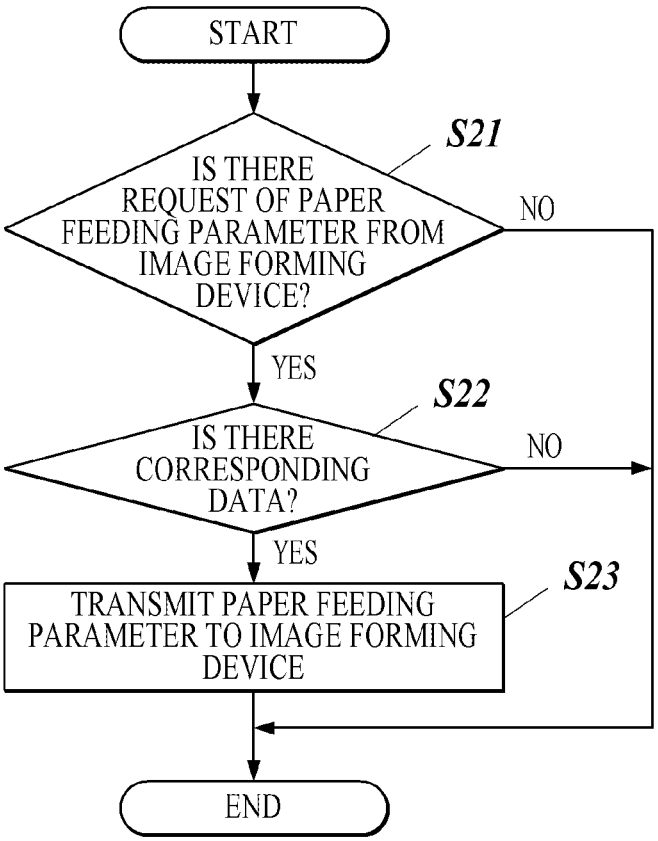
FIG. 10 is a flowchart illustrating a paper feeding parameter providing process executed in the management device.

FIG. 10 is a flowchart illustrating a paper feeding parameter providing process executed by the management device 40. This process is realized by software processing in cooperation with the CPU of the hardware processor 41 and the program stored in the ROM in cooperation with each other.

The hardware processor 41 first determines whether there is a request of the paper feeding parameter from any one of the image forming devices 10 (Step S21). The paper feeding parameter request includes the paper type information, the device configuration information, the disturbance information, and the model information.

When there is the request of the paper feeding parameter from the image forming device 10 (Step S21; YES), the hardware processor 41 refers to the in-criterion range table T1 and the disturbance adjustment table T2 stored in the storage 42 and determines whether there is data corresponding to the paper type information, the device configuration information, the disturbance information, and the model information obtained from the image forming device 10 (Step S22). Note that, it is also possible that the model information is not included in an extraction condition and data obtained by another model is used.

When there is the corresponding data (Step S22; YES), the hardware processor 41 reads the paper feeding parameter corresponding to the paper type information, the device configuration information, the disturbance information, and the model information obtained from the image forming device 10 from the in-criterion range table T1 and the disturbance adjustment table T2 and transmits the read paper feeding parameter to the image forming device 10 which makes a request via the communicator 43 (Step S23).

Specifically, when the disturbance information obtained from the image forming device 10 is within the criterion range, the hardware processor 41 obtains the paper feeding parameter corresponding to the paper type information, the device configuration information, and the model information obtained from the image forming device 10 from the in-criterion range table T1 and provides the same to the image forming device 10 which makes a request.

On the other hand, when the disturbance information obtained from the image forming device 10 is not within the criterion range, the hardware processor 41 obtains the paper feeding parameter difference corresponding to the paper type information, the device configuration information, the disturbance information, and the model information obtained from the image forming device 10 from the disturbance adjustment table T2 and obtains the paper feeding parameter corresponding to the paper type information, the device configuration information, and the model information obtained from the image forming device 10 from the in-criterion range table T1. Then, the hardware processor 41 provides the paper feeding parameter obtained by adding the paper feeding parameter difference obtained from the disturbance adjustment table T2 to the paper feeding parameter obtained from the in-criterion range table T1 to the image forming device 10 which makes a request.

At Step S21, when there is no request of the paper feeding parameter from the image forming device 10 (Step S21; NO), when there is no corresponding data at Step S22 (Step S22; NO), or after Step S23, the paper feeding parameter providing process ends.

As described above, according to the first embodiment, the management device 40 collects the paper type information, the device configuration information, the paper feeding parameters and the like transmitted from the plurality of image forming devices 10 (paper feeding devices 20) while associating them with one another, so that each of the image forming devices 10 (paper feeding devices 20) may share the paper feeding parameter, and the paper feeding parameters suitable for various types of paper may be set. Also, since the reliability of the paper feeding parameter regarding the reliability data is determined on the basis of the reliability data and it is determined whether to store the paper feeding parameter in the storage 42 according to the reliability, it is possible to secure the reliability of the adjustment result of the paper feeding parameter collected in the management device 40.

Specifically, when the management device 40 obtains the paper type information, the device configuration information, the paper feeding parameter, the reliability data and the like from the image forming device 10 and it is determined that the paper feeding parameter is reliable, the in-criterion range table T1 and the disturbance adjustment table T2 are updated, so that it is possible to increase the information regarding a compatible paper type in the entire paper feeding parameter management system 100. Also, regarding the paper feeding parameters for the same paper type information and device configuration information, accuracy of the in-criterion range table T1 may be improved by registering the average value.

Also, the reliability of the paper feeding parameter may be determined on the basis of the number of passed sheets, the jamming occurrence rate, the variation amount of the paper bending amount, the variation amount of the paper deviation amount, and the variation amount of the paper feeding timing in a state of using the adjusted paper feeding parameter.

Also, since the management device 40 obtains the device configuration information together with the paper type information and the paper feeding parameter from the image forming device 10, it is possible to set an appropriate paper feeding parameter according to whether the paper is the long paper, from which unit the paper is fed, and from which tray the paper is fed in a case where the paper feeding device 20 is a device compatible with long paper and in a case where a connection configuration in the paper feeding device 20 is complicated.

In addition, since the determination criterion of the reliability of the paper feeding parameter is changed on the basis of the device configuration information transmitted together with the paper feeding parameter, it is possible to secure the reliability of the adjustment result of the paper feeding parameter collected by the management device 40 by making the determination criterion of the reliability stricter regarding the paper feeding parameter for the paper in which the paper feeding defect easily occurs such as the long paper.

In addition, since the adjustment result is updated in consideration of the disturbance information such as the environmental information and the usage condition information, data obtained under special conditions may also be accumulated. It is important to collect the disturbance information together with the paper type information, the device configuration information, and the paper feeding parameter because a suitable paper feeding parameter differs depending on temperature and humidity, and whether the device is new or not.

For example, when the disturbance information is within the criterion range, the correspondence relationship among the paper type information, the device configuration information, and the paper feeding parameter is updated, and when the disturbance information is not within the criterion range, the paper type information, the device configuration information, and the paper feeding parameter (paper feeding parameter difference) transmitted together with the disturbance information are stored in association with the disturbance information, so that the adjustment result not including the effect of the disturbance and the information including the effect of the disturbance may be collected. Specifically, by calculating the paper feeding parameter without the effect of the disturbance in the management device 40, it is possible to share the paper feeding parameter with high accuracy.

In addition, by collecting the model information of the paper feeding device 20 and the image forming device 10 the paper feeding parameters of which are adjusted together with the paper type information, the device configuration information, and the paper feeding parameter, it is possible to cope with a case where tendency of the paper feeding parameter varies depending on the model. Specifically, information obtained by the paper feeding device 20 or the image forming device 10 of the same mode may be used.

Note that, although the device configuration information is included in the table (the paper feeding parameter table T0, the in-criterion range table T1, and the disturbance adjustment table T2) in the first embodiment, the table may be separated depending on whether the paper is the long paper or the plain paper. In this case, since the tray position is important when the paper is the long paper, the tray position may be added to only the table for the long paper as one of the conditions.

Although the paper feeding parameter difference is stored in association with the disturbance information in the disturbance adjustment table T2, the paper feeding parameter may also be stored in association with the disturbance information.

Also, the disturbance information managed by the paper feeding parameter table T0 and the disturbance adjustment table T2 may be a difference from the criterion value.

Second Embodiment

Next, a second embodiment to which the present disclosure is applied is described.

A paper feeding parameter management system according to the second embodiment has a configuration similar to that of the paper feeding parameter management system 100 described in the first embodiment, so that FIGS. 1 to 5 are incorporated and illustration and explanation of the configurations are omitted. Hereinafter, a configuration and a process characteristic to the second embodiment are described.

In the second embodiment, an arithmetic expression for calculating a paper feeding parameter from paper type information is used in managing a correspondence relationship among paper type information, device configuration information, a paper feeding parameter and the like.

A method of transmitting the paper type information, the device configuration information, the disturbance information, the model information, an adjusted paper feeding parameter, and reliability data from each image forming device 10 to a management device 40 is similar to that in the first embodiment.

When a hardware processor 41 of the management device 40 receives the paper type information, the device configuration information, the disturbance information, the model information, the paper feeding parameters, and the reliability data from each of a plurality of image forming devices 10, this determines reliability of the paper feeding parameter regarding the reliability data on the basis of the reliability data and determines whether to store the paper feeding parameter in a storage 42 according to the reliability. A method of determining the reliability of the paper feeding parameter is similar to that of the first embodiment.

In the second embodiment also, the hardware processor 41 may change a determination criterion of the reliability of the paper feeding parameter on the basis of the device configuration information transmitted together with the paper feeding parameter.

When the hardware processor 41 determines that the paper feeding parameter is reliable, this associates the paper type information, the device configuration information, the disturbance information, the model information, and the paper feeding parameter received from the image forming device 10 with one another and store in the storage 42. The data collected from each image forming device 10 is stored as it is.

The hardware processor 41 obtains the arithmetic expression for calculating the paper feeding parameter for each device configuration information (paper length, connection order, tray position and the like). Herein, the arithmetic expression is obtained separately for long paper and plain paper (other than the long paper).

The hardware processor 41 obtains the arithmetic expression for calculating the paper feeding parameter by dividing into a case where the disturbance information is within a criterion range and a case where the disturbance information is not within the criterion range. In the following description, the model information is not considered in order to simplify the explanation, but the arithmetic expression may also be obtained for each of the model information.

Case where Disturbance Information is within Criterion Range

As the paper feeding parameters, a side fan air volume E11, a tip end fan air volume E12, and an absorption time E13 on a paper feeding belt 38 are used. Also, as the paper type information, a basis weight A11, a surface property A12, and stiffness A13 are used.

From a correspondence relationship between the paper type information (A11, A12, and A13) and the paper feeding parameters (E11, E12, and E13) collected from each of the image forming devices 10, the hardware processor 41 obtains coefficients α11, β11, γ11, α12, β12, γ12, α13, β13, and γ13 in following equations (1) to (3).

$$E11=a11\times A11+\beta 11\times A12+\gamma 11\times A13 \quad (1)$$

$$E12=a12\times A11+\beta 12\times A12+\gamma 12\times A13 \quad (2)$$

$$E13=a13\times A11+\beta 13\times A12+\gamma 13\times A13 \quad (3)$$

The hardware processor 41 stores in the storage 42 arithmetic expressions (1) to (3) including the coefficients α11, β11, γ11, α12, β12, γ12, α13, β13, and γ13 as adjustment results in which the paper type information and the paper feeding parameter are associated with each other. Arithmetic expressions (1) to (3) are obtained for long paper and plain paper, respectively.

The hardware processor 41 determines whether the paper is the long paper or the plain paper on the basis of the paper length included in the device configuration information when there is a request for the paper feeding parameter from each image forming device 10. Then, the hardware processor 41 calculates the paper feeding parameters (E11, E12, and E13) corresponding to the paper type information according to expressions (1) to (3) described above for the long paper or plain paper, and sets the calculated paper feeding parameters to the image forming device 10 which takes a request.

Case where Disturbance Information is Out of in-Criterion Range

As the paper feeding parameters, a side fan air volume E21, a tip fan air volume E22, and an adsorption time E23 on the paper feeding belt 38 are used. Also, as the paper type information, a basis weight A21, a surface property A22, and stiffness A23 are used.

From a correspondence relationship between the paper type information (A21, A22, and A23) the paper feeding parameters (E21, E22, and E23), and the disturbance information collected from each of the image forming devices 10, the hardware processor 41 obtains coefficients $\alpha 21$, $\beta 21$, $\gamma 21$, $\alpha 22$, $\beta 22$, $\gamma 22$, $\alpha 23$, $\beta 23$, and $\gamma 23$ and disturbance offset values $\delta 21$, $\delta 22$, and $\delta 23$ in following expressions (4) to (6).

$$E21=\alpha 21\times A21+\beta 21\times A22+\gamma 21\times A23+\delta 21 \quad (4)$$

$$E22=\alpha 22\times A21+\beta 22\times A22+\gamma 22\times A23+\delta 22 \quad (5)$$

$$E23=\alpha 23\times A21+\beta 23\times A22+\gamma 23\times A23+\delta 23 \quad (6)$$

The hardware processor 41 stores in the storage 42 arithmetic expressions (4) to (6) including the coefficients $\alpha 21$, $\beta 21$, $\gamma 21$, $\alpha 22$, $\beta 22$, $\gamma 22$, $\alpha 23$, $\beta 23$, and $\gamma 23$ and the disturbance offset values $\delta 21$, $\delta 22$, and $\delta 23$ as adjustment results in which the paper type information and the paper feeding parameters are associated with each other. Arithmetic expressions (4) to (6) are obtained for the long paper and plain paper, respectively.

The hardware processor 41 determines whether the paper is the long paper or the plain paper on the basis of the paper length included in the device configuration information when there is a request for the paper feeding parameter from each image forming device 10. Then, the hardware processor 41 calculates paper feeding parameters (E21, E22, and E23) corresponding to the paper type information and the disturbance information according to above expressions (4) to (6) for the long paper or plain paper, and sets the calculated paper feeding parameters to the image forming device 10 which makes a request.

The hardware processor 41 learns the correspondence relationship between the paper type information and the like and the paper feeding parameter by reflecting the newly adjusted paper feeding parameter and the information such as the paper type information in the arithmetic expressions.

Next, operation in the paper feeding parameter management system according to the second embodiment is described.

A paper feeding parameter adjusting process executed in the image forming device 10 is similar to the process illustrated in FIG. 8.

As for a paper feeding parameter registering process executed by the management device 40, a part different from that in the process illustrated in FIG. 9 is described. Note that, the model information is not herein considered, too.

At Step S15, when it is determined that the paper feeding parameter is reliable (Step S15; YES), the hardware processor 41 registers the paper feeding parameter (Step S16). Specifically, the hardware processor 41 associates the paper type information, the device configuration information, the disturbance information, and the paper feeding parameter obtained from the image forming device 10, and stores them in the storage 42.

Next, the hardware processor 41 determines whether the disturbance information obtained at Step S11 is within the criterion range (Step S17).

When the disturbance information is within the criterion range (Step S17; YES), the hardware processor 41 associates the paper type information, the device configuration information, and the paper feeding parameter obtained at Step S11, and updates the adjustment result (Step S18). Specifically, the hardware processor 41 adds the newly obtained paper type information and paper feeding parameter, and recalculates arithmetic expressions (1) to (3) for the long paper or plain paper.

At Step S17, when the disturbance information is not within the criterion range (Step S17; NO), the hardware processor 41 associates the paper type information, the device configuration information, the disturbance information, and the paper feeding parameter obtained at Step S11 with one another and updates the adjustment result (Step S19). Specifically, the hardware processor 41 adds the newly obtained paper type information, disturbance information, and paper feeding parameter, and recalculates arithmetic expressions (4) to (6) for the long paper or plain paper.

At Step S15, when it is determined that the paper feeding parameter is not reliable (Step S15; NO), the hardware processor 41 does not register the paper feeding parameter (Step S20).

After Step S18, Step S19, or Step S20, the paper feeding parameter registering process is finished.

Next, a paper feeding parameter providing process executed by the management device 40 is described with reference to FIG. 10. Note that, the model information is not herein considered, too.

The hardware processor 41 first determines whether there is a request of the paper feeding parameter from any one of the image forming devices 10 (Step S21). The paper feeding parameter request includes the paper type information, the device configuration information, and the disturbance information.

When there is the request of the paper feeding parameter from the image forming device 10 (Step S21; YES), the hardware processor 41 determines whether there is data corresponding to the paper type information, the device configuration information, and the disturbance information obtained from the image forming device 10 (Step S22). Specifically, on the basis of the device configuration information obtained from the image forming device 10, the hardware processor 41 determines whether the paper to be fed is the long paper or plain paper. When the disturbance information obtained from the image forming device 10 falls within the criterion range, the hardware processor 41 determines whether arithmetic expressions (1) to (3) for the long paper or plain paper determined from the device configuration information is stored in the storage 42. On the other hand, when the disturbance information obtained from the image forming device 10 does not fall within the criterion range, the hardware processor 41 determines whether arithmetic expressions (4) to (6) for the long paper or plain paper determined from the device configuration information are stored in the storage 42.

When there is the corresponding data (Step S22; YES), that is, when the arithmetic expression used for calculating the paper feeding parameter is stored in the storage 42, the hardware processor 41 calculates the paper feeding parameter by using the arithmetic expression and transmits the calculated paper feeding parameter to the image forming device 10 which makes a request via the communicator 43 (Step S23).

Specifically, when the disturbance information is within the criterion range, the hardware processor 41 calculates the paper feeding parameter using arithmetic expressions (1) to (3) for the long paper or plain paper and provides the same to the image forming device 10 which makes a request.

On the other hand, when the disturbance information is not within the criterion range, the hardware processor 41 calculates the paper feeding parameter using arithmetic expressions (4) to (6) for the long paper or plain paper and provides the same to the image forming device 10 which requests.

At Step S21, when there is no request of the paper feeding parameter from the image forming device 10 (Step S21; NO), when there is no corresponding data at Step S22 (Step S22; NO), or after Step S23, the paper feeding parameter providing process ends.

As described above, according to the second embodiment, as in the first embodiment, the management device 40 collects the paper type information, the device configuration information, the paper feeding parameters and the like transmitted from the plurality of image forming devices 10 (paper feeding devices 20) while associating them with one another, so that each of the image forming devices 10 (paper feeding devices 20) may share the paper feeding parameters, and the paper feeding parameters suitable for various types of paper may be set. Also, since the reliability of the paper feeding parameter regarding the reliability data is determined on the basis of the reliability data and it is determined whether to store the paper feeding parameter in the storage 42 according to the reliability, it is possible to secure the reliability of the adjustment result of the paper feeding parameter collected in the management device 40.

Specifically, when the management device 40 obtains the paper type information, the device configuration information, the paper feeding parameter, the reliability data and the like from the image forming device 10 and the arithmetic expression is updated when it is determined that the paper feeding parameter is reliable, so that it is possible to improve the accuracy of the paper feeding parameter.

In addition, by obtaining the arithmetic expression on the basis of the data collected by the management device 40 from the plurality of image forming devices 10 (paper feeding devices 20), the paper feeding parameter corresponding to the paper type information may be easily calculated.

Note that, in the second embodiment, the paper feeding parameter calculated by the management device 40 by the arithmetic expression is provided to each image forming device 10 (paper feeding device 20), but it is also possible that the management device 40 provides the arithmetic expression to each image forming device 10 (paper feeding device 20) and the image forming device 10 side calculates the paper feeding parameter corresponding to the paper type information.

The description in the above-described embodiments is the example of the paper feeding parameter management system according to the present disclosure, and the present disclosure is not limited to this. A detailed configuration and detailed operation of each device forming the system may be appropriately changed without departing from the spirit of the present disclosure.

For example, characteristic processes in each embodiment may be combined.

In each of the above-described embodiments, the reliability of the paper feeding parameter is determined on the basis of the reliability data, and it is determined whether to reflect the paper feeding parameter in the table (in-criterion range table T1 and disturbance adjustment table T2) or the arithmetic expression according to the reliability. However, it is also possible to change weighting at the time of reflecting the paper feeding parameter in the table or the arithmetic expression according to the reliability. Specifically, the weighting is increased as the reliability is higher, and the weighting is decreased as the reliability is lower.

In the above-described embodiments, the paper type information of the paper to be fed is obtained by the paper type information detection sensor 35. However, the hardware processor 11 of the image forming device 10 may also obtain the paper type information input from the operation interface 13 by the user.

In each of the above-described embodiments, the disturbance information including the environmental information is obtained by the disturbance information detection sensor 21. However, the hardware processor 11 of the image forming device 10 may also obtain environmental information from the external device.

Also, in the plurality of image forming devices 10 (paper feeding devices 20), the paper feeding parameter may be shared between devices having the same model information, or the paper feeding parameter may be shared regardless of the model information.

In each of the above-described embodiments, a case where the hardware processor 11 of the image forming device 10 also serves as the hardware processor which controls the respective units of the paper feeding device 20 is described. However, the paper feeding device 20 may also be provided with a hardware processor different from the hardware processor 11.

Also, when accumulating the correspondence relationship between the paper type information and the like and the paper feeding parameter, it is also possible to obtain the paper feeding parameter according to the paper type information and the like by machine leaning while setting the paper type information and the like as an input and the paper feeding parameter as an output.

Although embodiments of the present disclosure have been described and illustrated in detail, the disclosed embodiments are made for purposes of illustration and example only and not limitation. The scope of the present disclosure should be interpreted by terms of the appended claims.

As used throughout this application, the words "can" and "may" are used in a permissive sense (i.e., meaning having the potential to), rather than the mandatory sense (i.e., meaning must). The words "include", "including", and "includes" and the like mean including, but not limited to. As used herein, the singular form of "a", "an", and "the" include plural references unless the context clearly dictates otherwise. As employed herein, the term "number" shall mean one or an integer greater than one (i.e., a plurality).

What is claimed is:

1. A paper feeding parameter management system, comprising:

air paper feeding devices each of which is provided with an air paper feeder which feeds paper by blowing air and by absorption to paper and which is provided with a paper feeding parameter capable of being switched; and a management device connected to the air paper feeding devices via a communication network, wherein each of the air paper feeding devices is provided with:

a paper type information obtaining unit which obtains paper type information of paper to be fed; and a first hardware processor which (i) adjusts the paper feeding parameter of the air paper feeder and (ii) transmits the paper type information obtained by the paper type information obtaining unit, device configuration information regarding a device configuration of the air paper feeding device, and the adjusted paper feeding parameter to the management device, wherein the management device is provided with a second hardware processor which (i) associates the paper type information, the device configuration information, and the paper feeding parameter transmitted from each of the air paper feeding devices to store in a storage, and (ii) sets the paper feeding parameter with reference to the storage, the paper feeding parameter having correspondence to:

the paper type information obtained by the paper type information obtaining unit of a first air paper feeding device to be processed among the air paper feeding devices; and the device configuration information of the first air paper feeding device, wherein the first hardware processor further transmits reliability data for the adjusted paper feeding parameter to the management device, and wherein the second hardware processor determines reliability of the paper feeding parameter regarding the reliability data based on the transmitted reliability data and determines whether to store the paper feeding parameter in the storage according to the reliability.

2. The paper feeding parameter management system according to claim 1, wherein the reliability data includes at least one of a number of passed sheets, a jamming occurrence rate, a variation amount of a paper bending amount, a variation amount of a paper deviation amount, and a variation amount of paper feeding timing in a state of using the adjusted paper feeding parameter.

3. The paper feeding parameter management system according to claim 2, wherein the reliability data is the number of passed sheets in a state of using the adjusted paper feeding parameter, and wherein the second hardware processor (i) stores the paper feeding parameter regarding the number of passed sheets in the storage when the number of passed sheets is not smaller than a predetermined number, and (ii) does not store the paper feeding parameter regarding the number of passed sheets in the storage when the number of passed sheets is smaller than the predetermined number.

4. The paper feeding parameter management system according to claim 1, wherein the reliability data is a jamming occurrence rate in a state of using the adjusted paper feeding parameter, and wherein the second hardware processor (i) stores the paper feeding parameter regarding the jamming occurrence rate when the jamming occurrence rate is not larger than a predetermined value, and (ii) does not store the paper feeding parameter regarding the jamming occurrence rate in the storage when the jamming occurrence rate is larger than the predetermined value.

5. The paper feeding parameter management system according to claim 1, wherein the reliability data is a variation amount of a paper bending amount, a paper deviation amount, or paper feeding timing in a state of using the adjusted paper feeding parameter, and wherein the second hardware processor (i) stores the paper feeding parameter regarding the variation amount when the variation amount is not larger than a predetermined value, and (ii) does not store the paper feeding parameter regarding the variation amount in the storage when the variation amount is larger than the predetermined value.

6. The paper feeding parameter management system according to claim 1, wherein the device configuration information includes at least one of a length in a conveying direction of paper, a connection order of air paper feeders which feed paper, and a tray position of the air paper feeder which feeds paper.

7. The paper feeding parameter management system according to claim 1, wherein the second hardware processor changes a determination criterion of reliability of the paper feeding parameter based on the device configuration information transmitted together with the paper feeding parameter.

8. The paper feeding parameter management system according to claim 1, wherein the paper type information includes a surface property, a basis weight, or stiffness of paper, and wherein the paper type information obtaining unit is a detector which detects the paper type information from the paper to be fed, or an obtaining unit which obtains the paper type information input by a user.

9. The paper feeding parameter management system according to claim 1, wherein the paper feeding parameter includes at least one of an air volume of a fan used for blowing air, an air volume of a fan used for absorption, and a lifting position of a tray on which paper is stacked.

* * * * *